United States Patent [19]

Scala

[11] Patent Number: 4,927,504

[45] Date of Patent: May 22, 1990

[54] SCULPTURE PROCESS

[76] Inventor: Christopher R. Scala, 1666 Summer Way, Winter Park, Fla. 32789

[21] Appl. No.: 407,144

[22] Filed: Sep. 14, 1989

[51] Int. Cl.[5] ..... C25D 9/08

[52] U.S. Cl. ..... 204/23; 204/56.1

[58] Field of Search ..... 204/23, 56.1

[56] References Cited

U.S. PATENT DOCUMENTS 4,246,075 1/1981 Hilbertz ..... 204/23

*Primary Examiner*—T. M. Tufariello

*Attorney, Agent, or Firm*—William M. Hobby, III

[57] ABSTRACT

A process of making a sculpture includes the basic steps of making a plaster sculpture model and then cutting and shaping a heavy metal wire cloth over the sculpture model. A structural framework is formed using the plaster model as a guide. The wire cloth which has been cut to size is shaped over the plaster model to form the general shape of the plaster model and the metal wire cloth is removed and attached to the structural framework and the frame with metal cloth attached is placed in an electrolyte, such as seawater, and an electrical conductor connected to the metal wire cloth to act as one electrode of an electrolytic cell. The second electrode is placed adjacent the metal sculpture and a voltage applied across the electrodes to accrete the metal sculpture to form a sculpture of the same general shape as the shape of the metal wire cloth attached to the support frame.

10 Claims, 2 Drawing Sheets

SCULPTURE PROCESS

BACKGROUND OF THE INVENTION

The present invention relates to a process of making a sculpture and especially to a process which preforms a metal shape and electrolytically accretes the shape in an electrolytic cell.

In the past, it has been common to provite a number of processes for creating artworks and in the case of sculpture small models have been formed of plaster or other easily worked materials which may be a smaller model of the sculpture being produced. It has also been common to make full size models with plaster or other easily formable materials which are then used to make molds and then to mold the sculpture in the mold made from the original pattern. The present invention is directed towards a sculpture process which makes a full size plaster model for shaping and forming a heavy metal wire cloth and which is also used to build a heavy metal frame for attaching the wire cloth to produce a skelenton structure of what will be the finished sculpture. Electrolysis has been used to accrete materials onto the skeletal structure to form the finished sculpture which is then polished or finished as desired.

It has also been common in the past to use electrolysis for a wide variety of techniques especially in the fine coating of metals in which a direct current is used in an electrolytic cell having an anode electrode and cathode electrode placed in an electrolyte solution placed in the cell container. The application of a voltage will coat the cathode. The process is used in the separation of metals and materials as well as fine coating of metals and a wide variety of industrial processes. One process which has been described in the prior art may be seen in the U.S. Pat. No. 4,461,684 to Hilbertz shows an accretion coating and mineralization of materials for the protection against biodegradation and uses a direct electrical current between electrodes in seawater to precipitate materials onto the cathode to provide a mineral coating on the structure made of a fibrous material. The process is used in connection with marine structures which are being reinforcei as more clearly set forth in the Hilbertz U.S. Pat. No. 4,440,605 for the repair of reinforced concrete structures by mineral accretion. A metal reinforcement mated cathode in an underwater structure, such as a piling, is connected to a negative terminal of a suitable DC power supply and one or more anodes are disposed in close proximity to the structure for a sufficient period of time to accrete cracks in fissures or voids in the concrete body of the structure. The process of the these two patents can also be seen in an article in Marine Technology Society Journal, Volume 17, No. 4, copyrighted in 1984 entitled "The Properties of Electrodeposited Minerals in Seawater" and in an article in the IEEE Journal of Oceanic Engineering, Volume OE-4, Number 3, dated July 1979 written by the patentee on the two above patents. This article on Electro-deposition of Minerals in Seawater: Experiments and Applications, discusses establishing a direct electrical current between electrodes and an electrolyte like seawater to precipitate calcium carbonates, magnesium hydroxides, and hydrogen at the cathode while the anode produces oxygen and chlorine. The article deals with experiments made by the author which demonstrate in part the feasibility of using the electrodeposited minerals and building materials for a wide variety of purposes including the construction of artificial reefs.

The present invention deals with the method of making an artwork or sculpture which forms a full size plaster model of the ultimate sculpture with a plaster or other workable material, then using the model to make a metal frame and the forming of a heavy wire cloth shaped directly onto the plaster model. The wire cloth is then attached to the frame and the entire skeletal metal structure is used as a cathode in an electrolyte solution adjacent one or more anodes for accreting materials thereon to form an artwork which may then be polished and worked into the final sculpture.

SUMMARY OF THE INVENTION

The process of making an artwork or sculpture includes the basic steps of making a shaped plaster model of the final sculpture, then making a structural metal framework using the plaster model as a guide. Since the accretion is not intended to be structural, the framework is made of sufficient strength to support the completed sculpture. A pattern is cut in a flexible material and a heavy gauge wire cloth is cut to the shape of the pattern. The wire cloth is then formed over the plaster model and shaped, such as by hammering, binding or stretching. The shaped wire cloth is removed from the plaster model and attached to the structural framework to thereby form a skeletal form of a sculpture which is then placed into an electrolyte solution, such as seawater, and is connected with an electrical conductor to form a cathode. The skeletal shape may be cleaned and sandblasted to increase the surface area prior to immersing in the electrolyte and weighed to calculate the desired voltage and current to use to form the sculpture. One or more anodes are then placed adjacent the cathode and a direct current voltage is applied between the anode and cathode for a length of time to accrete a coating over the entire metal skeletal sculpture. The sculpture may then be removed from the electrolyte and cleaned and polished as desired. A heavy wire cloth may be coated on the inner side with a polymer or natural rubber or fiberglass material or the like so that accretion is only on the outer surface of the metal wire cloth.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
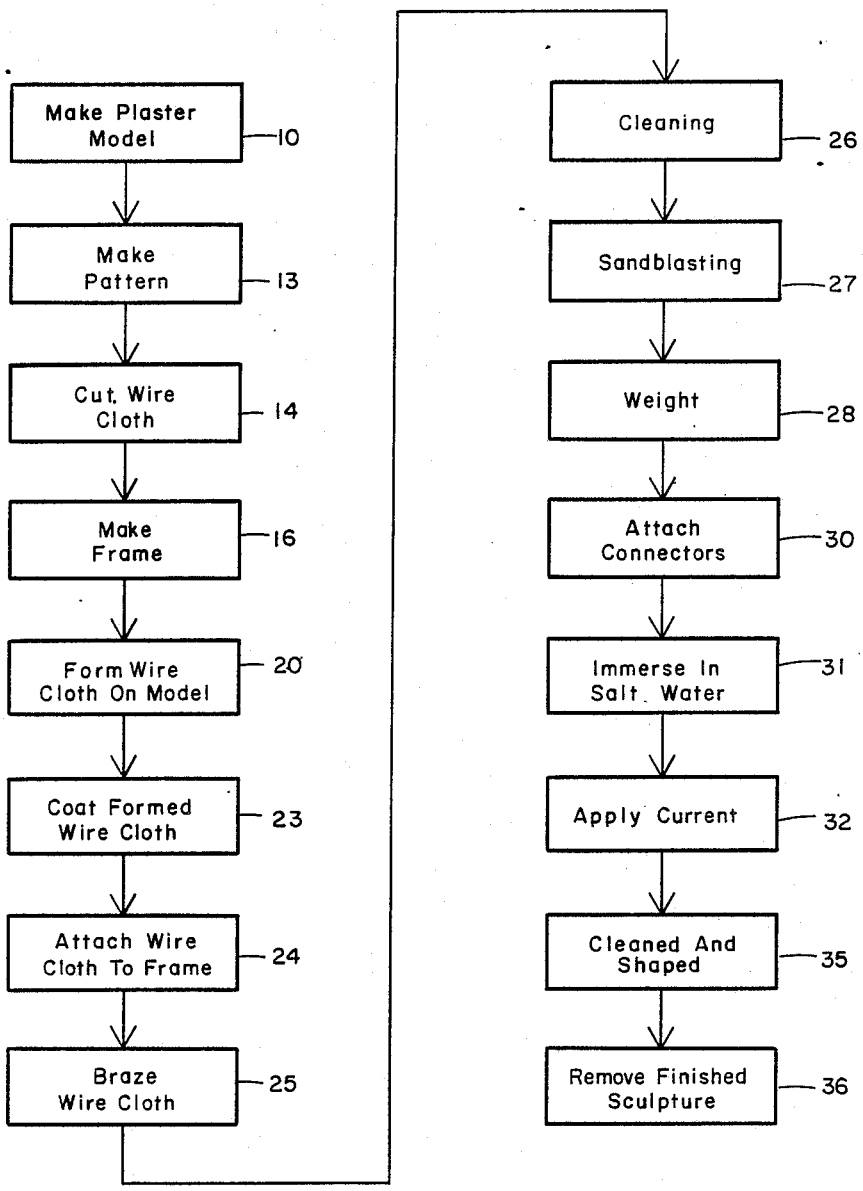
FIG. 1 is a flow diagram of the process in accordance with the present invention.
Figure 2:
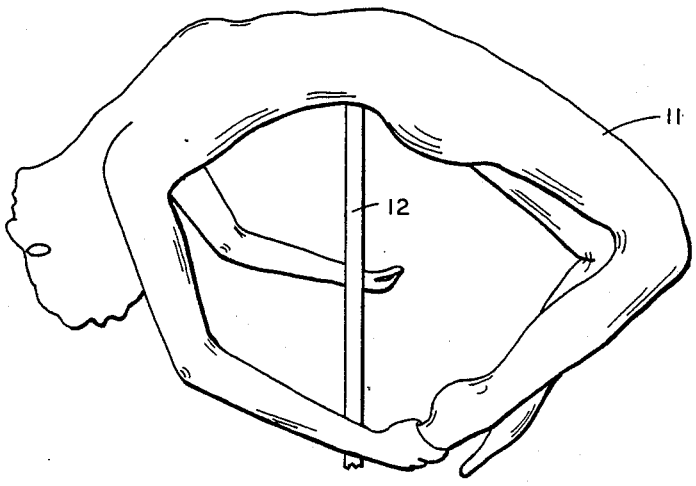
FIG. 2 is a side elevation of a plaster model formed in the process of the present invention.
Figure 3:
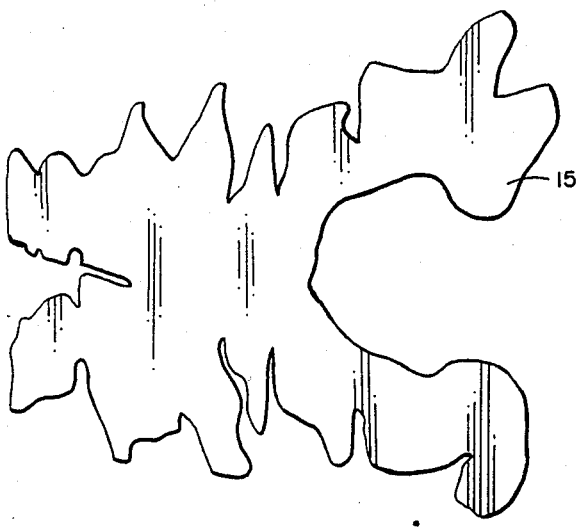
FIG. 3 is a top plan view of the pattern formed on the model of FIG. 1 for use in cutting the heavy metal wire cloth.
Figure 4:
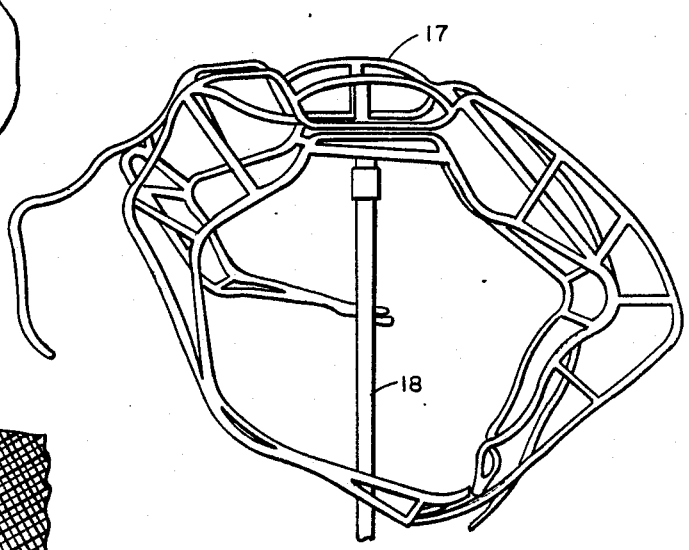
FIG. 4 is a side elevation of the metal frame shaped after the plaster model of FIG. 1.

Referring to the drawings and especially to FIG. 1, a flow diagram illustrates the process of the present invention for forming a sculptural artwork. The process starts with the making of a full size plaster model (10), such as shown in FIG. 2 in which a human FIG. 11 is formed of plaster by the artist and rests on a support member 12. The artwork 11 can be of any shape or form desired in accordance with the artist's imagination. Once the full size plaster model 11 is formed, a pattern (13) is formed for cutting a heavy wire cloth to be shaped the same general shape as the plaster model 11. The pattern can be cut of any flexible material, which is wrapped on the surface of the artwork 11 and cut to shape from which the heavy gauge wire cloth can be cut (14) to follow the pattern which may produce hardware cloth or heavy gauge wire cloth 15 in FIG. 3 shaped to fit over the artwork 11. A frame is then made (16), such as shown in FIG. 4, having a heavy metal frame 17, such as steel or any ferrous or non-ferrous metal, held by a steel post 18. The structural framework is made using the plaster model 11 as a guide.

Figure 5:
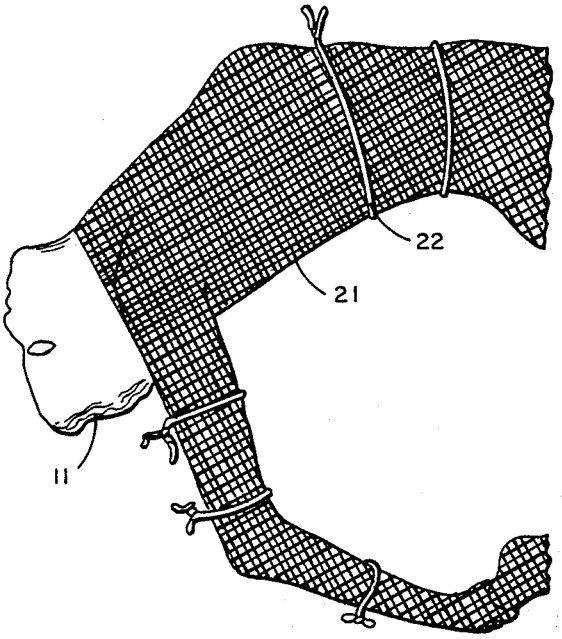
FIG. 5 is a partial side elevation of the cut metal wire cloth shaped onto the plaster model of FIG. 1.

The framework is made of sufficient strength to support the final sculpture following the completion of the process. Wire cloth 15 of FIG. 3 is then formed (20) over the plaster model as shown in FIG. 5. Wire cloth is fitted over the plaster and shaped to conform to the plaster model by hammering, bending, and stretching to form a shaped heavy gauge wire cloth 21 eround the plaster model 11 to form a skeletal skin for the sculptural work being worked on. When the wire cloth skin is shaped like the sculpture, it may be removed and then insulated on the backside of the sculpture with a plastic material. The metal wire can be held with wire wraps 22. The shaped wire cloth is coated (23) or insulated on the backside with a polymer, rubber or fiberglass at this time prior to being attached (24) to the frame 17. The wire cloth may be attached to the frame 17 by brazing the wire to the frame 17 or to adjacent wire cloth at selected points so that a skeletal shape is formed attached to a heavy framework 17.

Figure 6:
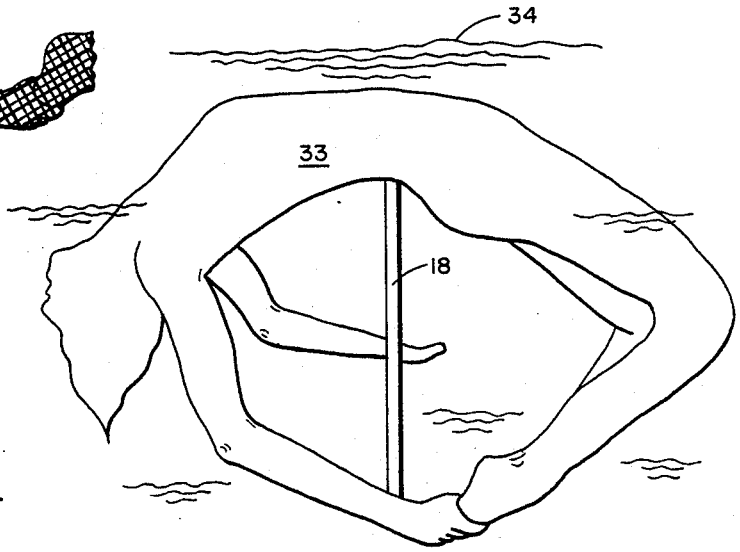
FIG. 6 is a side elevation of the sculpture being formed in an electrolyte.

Brazing the wire cloth (25) is then followed by the cleaning (26) and sandblasting (27) as desired to prepare the surface for the electrolytic solution and to remove any insulating coating on the outer surface of the sculpture. The entire sculpture is weighed (28) for determining the size for calculating the necessary DC voltage and power for use in the accretion process. Electrical conductors are then attached to the skeletal framework having the frame 17 and the wrapped wire 27 attached thereto for acting as a cathode which is then immersed (31) in an electrolyte solution, which may be sea water or which may be in a separate container having an electrolyte solution therein. Anode electrodes are positioned in the seawater adjacent the immersed structural framework, or alternatively, a metal container used to hold the electrolyte for immersion of the cathode may act as the anode electrode. The anode has to have an electrical conductor of opposite DC voltage to that of the cathode and then a power supply can supply the electrical power to create a voltage between the anode and cathode (32). The skeletal sculpture 33 is shown immersed in the electrolyte 34 in FIG. 6.

The process of accreting sufficient material over the sculpture artwork may take a considerable period of time, such as months, but I have found that coating the back of the wire cloth so that the accretion takes place on the front speeds up the process. Once the sculpture is fully covered as desired, it is removed from the electrolyte in FIG. 6 and cleaned and shaped (35) and the entire sculpture is removed as a finished sculpture (36). The sculptor can leave the work unfinished to provide a desired finish and will have an appearance such as metal objects which may have been left in the ocean for hundreds of years. The object may also be smoothed and cleaned and given a desired patina to provide a more finished sculptural work which in any event results in an archival permanent sculpture which may be used under adverse wet conditions, such as in fountains or as outdoor public sculptures.

It should be clear at this time that a process has been provided for creating an archival permanent sculpture having an aesthestic surface patterns and appearance which is given the overall shape by the artist. However, the present invention is not to be construed as limited to the forms shown which are to be considered illustrative rather than restrictive.

I claim:

1. A process of making a sculpture comprising the steps of:
   - making a shaped sculpture model;
   - shaping a metal wire cloth over said said sculpture model;
   - forming a support frame for a sculpture;
   - attaching said shaped metal wire cloth to said support frame;
   - connecting a conductor to said shaped wire cloth on said frame to act as one electrode of an electrolytic cell;
   - placing said shaped metal wire cloth attached to said frame in an electrolyte;
   - positioning an electrode adjacent said metal wire cloth and frame in said electrolyte; and
   - applying a voltage between said electrodes for a predetermined time to thereby electrolytically coat said metal wire cloth to form an acreted sculpture over said shaped metal wire cloth.

2. The process of making a sculpture in accordance with claim 1 including the step of cutting a pattern for said sculpture and then cutting said metal wire cloth to match said pattern.

3. The process of making a sculpture in accordance with claim 2 in which the step of making a shaped sculpture includes making a full scale plaster sculpture model.

4. The process of making a sculpture in accordance with claim 3 in which the step of attaching said metal shaped wire cloth to said support frame includes brazing said metal shaped wire cloth to said metal support frame.

5. The process of making a sculpture in accordance with claim 4 in which the step of placing said shaped metal wire cloth attached to said support frame includes placing said shaped metal wire cloth and support frame into seawater.

6. The process of making a sculpture in accordance with claim 5 in which the step of shaping metal wire cloth over said sculpture model includes hammering and bending said metal wire cloth to shape the metal wire cloth to the sculpture model..

7. The process of making a sculpture in accordance with claim 6 including the step of sandblasting said metal wire cloth attached to said support frame prior to placing said shaped metal wire cloth attached to said support frame in an electrolyte.

8. The process of making a sculpture in accordance with claim 7 including the step of weighing said shaped metal wire cloth and support frame after sandblasting said shaped metal wire cloth and support frame.

9. The process of making a sculpture in accordance with claim 6 including the step of removing said acreted sculpture from said electrolyte and cleaning said acreted sculpture.

10. The process of making a sculpture in accordance with claim 1 including the step of coating one side of said metal wire cloth with a polymer material.

* * * * *